US005117151A

United States Patent [19]

Sluyterman et al.

[11] Patent Number: 5,117,151

[45] Date of Patent: May 26, 1992

[54] COLOR DISPLAY TUBE WITH TWIST CORRECTION MEANS

[75] Inventors: Albertus A. S. Sluyterman; Nicolaas G. Vink; Fransiscus M. P. P. Doomernik, all of Eindhoven, Netherlands

[73] Assignee: U.S. Philips Corporation, New York, N.Y.

[21] Appl. No.: 542,218

[22] Filed: Jun. 21, 1990

[30] Foreign Application Priority Data

Jun. 23, 1989 [NL] Netherlands ..... 8901589

[51] Int. Cl.[5] ..... H01J 29/76

[52] U.S. Cl. ..... 313/413; 313/431; 313/440

[58] Field of Search ..... 313/440, 413, 431

[56] References Cited

U.S. PATENT DOCUMENTS 4,962,333 10/1990 Sluyterman ..... 313/413 X

FOREIGN PATENT DOCUMENTS 24726 3/1978 Japan ..... 313/440

*Primary Examiner*—Palmer C. DeMeo

*Attorney, Agent, or Firm*—Robert J. Kraus

[57] ABSTRACT

In-line color display tube with a deflection unit, provided with a twist correction device comprising two permanent magnets which generate magnetic fields with oppositely directed magnetic field components which, at the beginning and the end of a path traversed by each side beam, are transverse to the path of the relevant side beam and are located in the plane of the beams. This provides the possibility of deflecting each side beam once up and once down for compensating twist errors.

4 Claims, 2 Drawing Sheets

COLOR DISPLAY TUBE WITH TWIST CORRECTION MEANS

BACKGROUND OF THE INVENTION

The invention relates to a color display tube whose neck accommodates an electron gun system for emitting three co-planar electron beams towards a display screen, i.e. a central beam coinciding at least substantially with the axis of the display tube and two side beams located on both sides thereof, and a deflection unit which is secured coaxially around the display tube, which deflection unit comprises a system of line deflection coils which, when energized, deflects the electron beams in a first direction, and a system of field deflection coils which, when energized, deflects the electron beams in a direction transverse to the first direction.

In color display tubes of the in-line type the electron gun system is adapted to generate three co-planar electron beams which converge on the display screen. The deflection unit arranged around the display tube for deflecting the electron beams is used to deflect the electron beams in the one or the other direction from their normal undeflected straight path, so that the beams impinge upon selected pixels of the display screen so as to provide visual indications on this screen. By varying the magnetic deflection fields in a suitable manner, the electron beams can be moved up or down and to the left or the right across the (vertically arranged) display screen. By simultaneously varying the intensity of the beams, a visual presentation of information or a picture can be formed on the display screen. The deflection unit secured around the cone portion of the display tube comprises two systems of deflection coils so as to be able to deflect the electron beams in two directions which are transverse to each other. Each system comprises two coils which are arranged at opposite sides of the neck of the tube, which systems are 90° offset around the neck of the tube. Upon energization, the two systems of deflection coils produce orthogonal deflection fields.

The fields are essentially perpendicular to the path of the non-deflected electron beams. A cylindrical core of magnetizable material, which surrounds the system of line deflection coils if it is of the saddle type, is generally used to concentrate the deflection fields and to increase the flux density in the deflection region.

The deflection coils may be of the saddle type, or of the type which is toroidally wound on the annular core (particularly the field deflection coils).

After mounting a deflection unit comprising field deflection coils and line deflection coils on the display tube for which the unit is intended, twist errors sometimes appear to occur in operation. A twist error is understood to means the parabolic convergence error of the red and blue beams in the Y direction which is produced on rotation of the side beam (RBY error). This problem is not new, but it becomes urgent if very strict requirements are imposed on the convergence performance, as in CMT and HDTV applications.

SUMMARY OF THE INVENTION

It is therefore one of the objects of the invention to provide an effective twist correction means preferably enabling each display tube to be separately corrected (as far as value and sign are concerned).

According to the invention a color display tube of the type described in the opening paragraph is therefore characterized in that a twist correction device placed outside the paths of the side beams is arranged proximate to the entrance side of the deflection unit, which device comprises a magnet system generating magnetic fields with oppositely directed field components which, at the beginning and the end of a path of each side beam, are transverse to the relevant path and are located in the plane of the relevant beams, while corresponding field components of the two paths are oppositely directed.

In its simplest form the twist correction device according to the invention comprises two diametrically arranged static magnets at the gun side of the deflection unit, each magnet being positioned next to a side beam.

In one embodiment the magnets, viewed in the XZ plane, extend at a small angle $\phi$ to the z axis of the tube. This angle is of the same order of magnitude as that of the side beams in the same plane. The principle of this twist correction is based on causing a beam rotation. Therefore, the magnets are positioned in such a way that the two side beams are subjected to an oppositely directed vertical force when they traverse this static field. While the beams traverse the static magnetic field, the vertical force on a side beam will reverse its direction. Thus, a side beam is deflected twice on this path, in opposite directions. A controllable beam rotation and hence a defined twist error can be realized in this way. By rotating the two magnets through 180 degrees in the YZ plane, the sign of the twist error can be reversed. The value can be controlled by using a different magnet strength. The advantages of this twist correction are that twist errors can be corrected in an inexpensive and simple manner. This correction can be performed during the operation of matching the coil and the tube, while the strength and orientation of the magnets can be adapted to the value and the sign of the twist error.

Instead of (longitudinal) rod magnets, transversal rod magnets each cooperating with a pair of poleshoes can be used within the scope of the invention so as to generate the longitudinal magnetized regions which are required for twist correction. These transversal rod magnets may be rotatable about their longitudinal axis so as to enable the strength of the field between the poleshoes to be adjusted.

Another alternative is a configuration of permanently magnetizable material arranged in the tube proximate to the screen side of the gun. When a twist error is found, this configuration (for example, an annular strip) can be magnetized in such a way that the twist error is corrected.

BRIEF DESCRIPTION OF THE DRAWING

Some embodiments of the invention will be described in greater detail by way of example with reference to the accompanying drawing figures in which.

DESCRIPTION OF THE PREFERRED EMBODIMENTS

Figure 1:
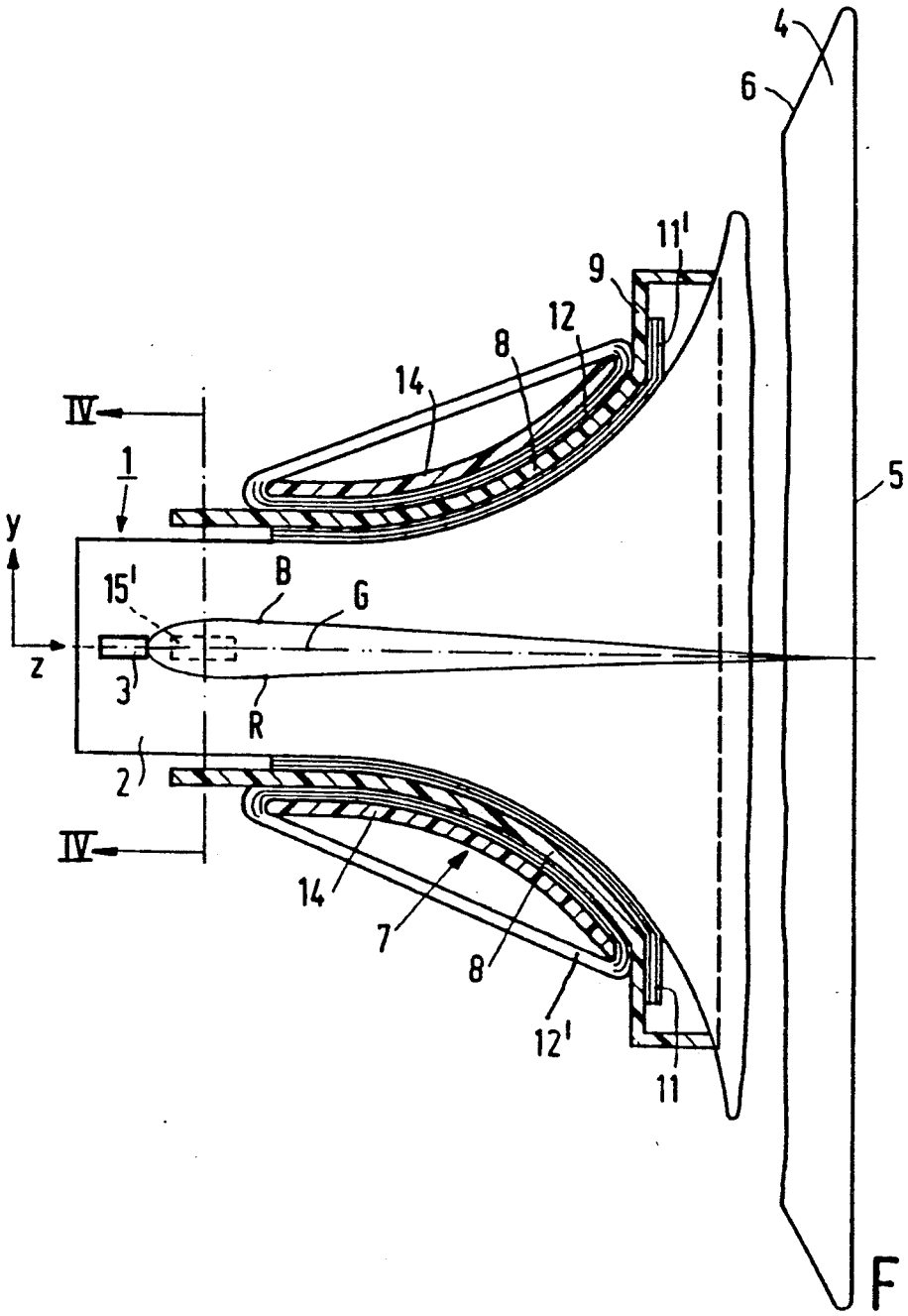
FIG. 1 is a diagrammatic elevational view of a cross-section (taken on the y–z plane) of a color display tube on which a deflection unit and a twist correction device are mounted.

FIG. 1 shows in a cross-section a color display tube 1 having an envelope 6 extending from a narrow neck portion 2, accommodating an electron gun system 3, to a wide, flared portion 4 which is provided with a display screen 5. A deflection unit 7 is mounted on the tube at the interface between the narrow and the wide portion. This deflection unit 7 has a support 8 of electrically insulating material with a front end 9 and a rear end 10. A system of deflection coils 11, 11' for generating a (line) deflection field for deflection in the horizontal direction of the electron beams produced by the electron gun system 3 is arranged between these ends 9 and 10 at the inner side of the support 8. The system of deflection coils 11, 11' is surrounded by an annular core 14 of a magnetizable material on which, in this embodiment, a set of coils 12, 12' for generating a (field) deflection field for deflection in the vertical direction of electron beams produced by the electron gun system 3 is wound toroidally. The coils 11, 11' of the line deflection coil system comprise a first side packet and a second side packet, and a rear end section (facing the gun 3) and a front end section (facing the display screen 5) which jointly define a window. In the Figure the rear end section is arranged in a lying configuration as compared with the front end section. However, the invention also relates to line deflection coils having an upstanding rear end section.

Figure 4:
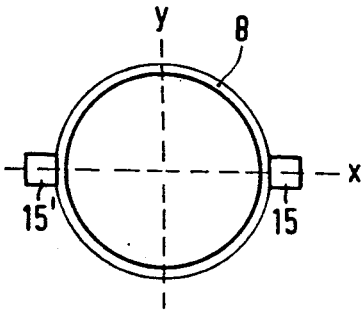
FIG. 4 is a cross-section through the tube of FIG. 1 taken on the line IV—IV.

A twist correction device is added to the deflection unit 7, which device in this embodiment comprises two permanent rod magnets 15, 15' which are magnetized in the longitudinal direction of the tube 1. As is more clearly shown in FIG. 4, the (axes of the) magnets 15, 15' are located in the X-Z plane, i.e. the plane in which the non-deflected electron beams R, G, B are located. The magnets 15, 15' may be arranged at the end of the support 8, but this is not the only possibility.

Figure 2:
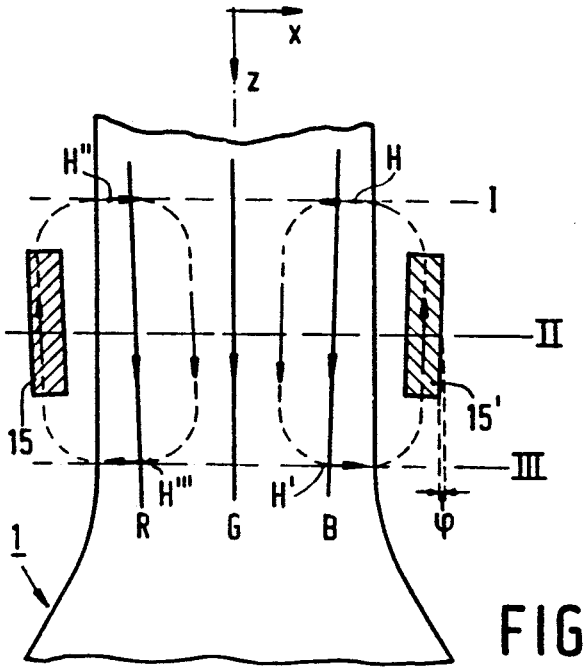
FIG. 2 is a magnification of a part of the cross-section of FIG. 1 showing the twist correction device used in greater detail.

As is shown in greater detail in FIG. 2, magnet 15' produces a magnetic field with oppositely directed field components H and H' at the beginning and end of a path in the tube, which components are transverse to the path of the adjacent (blue) beam B. In a corresponding manner, magnet 15 produces a magnet field with field components H'' and H''' which are transverse to the path of the adjacent (red) beam R.

Figure 3:
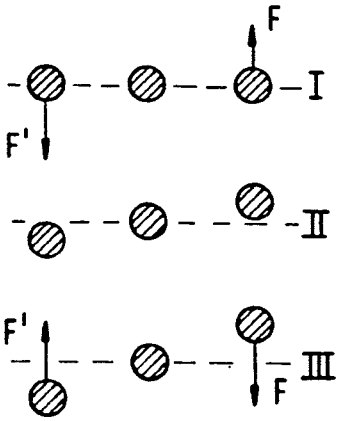
FIG. 3 shows front elevations of electron beams in three cross-sections through the tube of FIG. 2.

The effect of the fields produced by the magnets 15, 15' is elucidated with reference to FIG. 3 showing front elevations of the electron beams in the cross-sections I, II and III of FIG. 2. When they traverse the path in the display tube 1 where the fields of the magnets 15, 15' are produced, the side beams are initially subjected to oppositely directed forces F and F' (cross-section I) so that they are forced up and down, respectively, in the direction of the tube wall (cross-section II). When the beams traverse the static fields, however, these forces change sign (III). Thus, each side beam is deflected twice in opposite directions when it traverses this path. This is once more elucidated in FIG. 4. In this way a controllable beam rotation and hence a defined twist can be realised, with which an occurring twist error can be corrected. This correction can be performed while matching the deflection unit and the display tube, and the strength and orientation of the magnets 15, 15' can be adapted, dependent on the magnitude and the sign of the twist error. By placing the magnets 15, 15' at a specific angle $\phi$ (FIG. 2) to the z axis, which angle is to be determined separately for each type of display tube and deflection unit combination, it is possible, if desired, to ensure that the magnets 15, 15' have a minimum influence on the static convergence.

Figure 5:
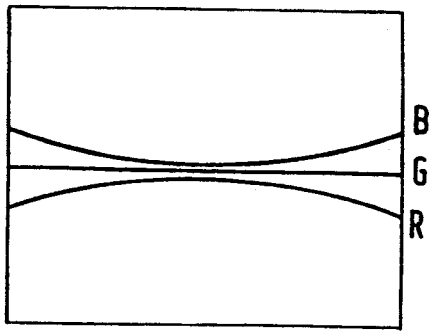
FIG. 5 shows diagrammatically a raster with a twist error on the display window of the tube of FIG. 1.

The twist error (parabolic RBY error) which can be corrected is shown in FIG. 5.

Figure 6:
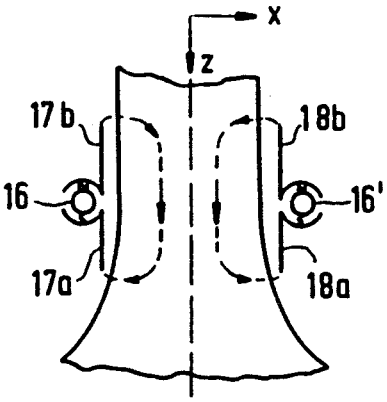
FIGS. 6 and 7 show different embodiments of a twist correction device for use in a display tube according to the invention.

Instead of longitudinal magnets 15, 15', "transversal" magnets 16, 16' which are transverse to the x-z plane and cooperate with poleshoe pairs 17*a*, 17*b* and 18*a*, 18*b*, respectively, can be used (FIG. 6). The magnets may be diametrically magnetized in a plane transverse to their height direction and they may be arranged rotatably so as to enable adjustment of the desired field strength.

Figure 7:
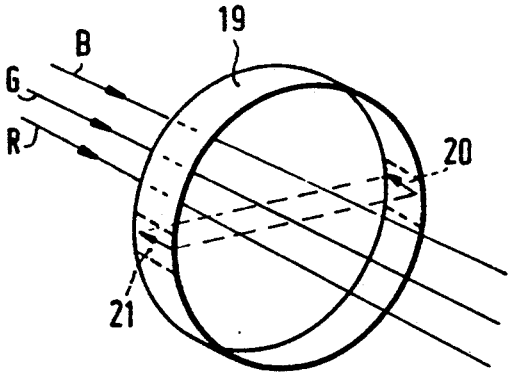

Another alternative is the use of a configuration of permanently magnetizable material (for example, an annular strip 19, FIG. 7) which can be arranged at the screen side of the gun (for example, in the centring cup) and which, upon finding a twist error, for example, during matching, can give regions 20, 21 the required magnetic induction and orientation by external magnetization so as to correct the twist error. Moreover, the magnetic poles which are required to correct other static (convergence) errors can be magnetized in the annular strip. An alternative for correcting twist errors is the use of two permanently magnetizable "slices" arranged on both sides of the beams, either or not in combination with a separate (annular) magnet configuration for correcting static convergence errors.

We claim:

1. A color display tube comprising an envelope having a neck portion and including a display screen, said neck portion containing an electron gun system for emitting coplanar electron beans toward the display screen, said electron beams including a central beam substantially coinciding with an axis of the display tube and first and second side beams, said envelope being adapted for supporting a deflection unit for deflecting the electron beams in first and second mutually transverse directions, characterized in that the display tube comprises twist correction means disposed outside the paths of the side beams and proximate to a beam entrance side of the deflection unit, said means producing at a first position along the beam paths first and second mutually opposing magnetic field components for respectively deflecting the first and second outer electron beams transversely of the plane in opposite directions, and producing at a second position along the beam paths third and fourth mutually opposing magnetic field components, in directions opposite to the first and second field components, for respectively deflecting the first and second outer electron beams transversely of the plane in opposite directions.

2. A color display tube as claimed in claim 1, characterized in that the twist correction device comprises two longitudinal magnets of the same orientation arranged at the outer side of the tube and located diametrically in the plane of the beams.

3. A color display tube as claimed in claim 1, characterized in that the twist correction device comprises two magnets located diametrically in a plane transverse to the plane of the beams, each magnet cooperating with a pair of poleshoes.

4. A color display tube as claimed in claim 1, characterized in that the twist correction device comprises a configuration of permanently magnetic material arranged proximate to the screen-sided end of the gun, in which configuration two regions having the same orientation and located diametrically in the plane of the beams are magnetized.

* * * * *